US005777651A

United States Patent [19]

Facci et al.

[11] Patent Number: 5,777,651

[45] Date of Patent: Jul. 7, 1998

[54] IONOGRAPHIC CHARGING APPARATUS AND PROCESSES

[75] Inventors: John S. Facci, Webster; Milan Stolka, Fairport; Michael J. Levy; Martin A. Abkowitz, both of Webster; James M. Markovics, Rochester, all of N.Y.

[73] Assignee: Xerox Corporation, Stamford, Conn.

[21] Appl. No.: 452,807

[22] Filed: May 30, 1995

[51] Int. Cl.[6] ..... G03G 15/02; G03G 13/02

[52] U.S. Cl. ..... 347/123; 361/225; 430/902; 399/168

[58] Field of Search ..... 347/123, 125, 347/126; 430/53, 902; 399/168, 169, 174, 175; 361/225, 234

[56] References Cited

U.S. PATENT DOCUMENTS

| | | | |
|---|---|---|---|
| 2,097,233 | 10/1937 | Meston | 347/123 |
| 2,904,431 | 9/1959 | Moncrieff-Yeates | 96/1 |
| 2,987,660 | 6/1961 | Walkup | 317/262 |
| 3,394,002 | 7/1968 | Bickmore | 96/1 |
| 4,086,650 | 4/1978 | Davis et al. | 361/229 |
| 4,585,320 | 4/1986 | Altavela et al. | 355/3 CH |
| 4,644,373 | 2/1987 | Sheridan et al. | 346/159 |
| 5,315,324 | 5/1994 | Kubelik et al. | 346/159 |
| 5,377,070 | 12/1994 | Kawamoto | 361/229 |
| 5,457,523 | 10/1995 | Facci et al. | 355/219 |
| 5,510,879 | 4/1996 | Facci et al. | 355/219 |
| 5,602,626 | 2/1997 | Facci et al. | 399/135 |

OTHER PUBLICATIONS

Photographic Science and Engineering, "Characteristics of Corona Discharge and Their Application to Electrophotography", Michael M. Shahin, vol. 15, No. 4, Jul.–Aug. 1971, pp. 322–328.

Current Problems in Electrophotography, R. B. Lewis & H. M. Stark, Walter deGruyter, 1972, p. 328.

*Primary Examiner*—Valerie Lund

*Attorney, Agent, or Firm*—E. O. Palazzo

[57] ABSTRACT

An apparatus for charging an ionographic member, comprising an electrically insulating substrate containing affixed thereto a plurality of electroded grooves each capable of retaining a single wettable fiber, thereby forming a collection of fibers in contact with the substrate; a resin layer that isolates said fibers from each other, and that adheres the fibers to the electroded grooves; providing an ionically conductive fluid to said collection of fibers; applying an electrical bias to said fibers thereby transporting ions through the fibers to the surface of said ionographic member and which ions charge said member.

29 Claims, 2 Drawing Sheets

IONOGRAPHIC CHARGING APPARATUS AND PROCESSES

BACKGROUND OF THE INVENTION

This invention is generally directed to processes for charging imaging members, such as dielectric charge receivers, for ionography. More specifically, in embodiments the present invention relates to devices and processes wherein a latent image is deposited on a receptor by liquid contact thereof, and wherein, for example, a thin array of polymeric wicks in contact with an electroded substrate is selected for the writing of pixel by pixel onto a receptor. Subsequently, the latent image can be developed with toner particles, transferred, and fixed as in conventional xerography. The aforementioned devices and processes of the present invention possess a number of advantages and uses including, for example, in an economical highlight color printer in that, for example, individual ion conducting channels, or fibers of the device can be biased to a negative or positive polarity, or the fingers can be grounded. Also, each of the fingers can be biased to any desired voltage thus enabling gray scales. More specifically, the devices and processes of the present invention can be selected for trilevel color processes wherein erasure of the residual latent electrostatic image can be avoided; dry or liquid development can be selected; no light sensitive systems are present and thus protection therefrom is avoided; no or minimal ozone is generated; photoreceptors, lasers, rotating polygons, and the like can be eliminated; and there can be obtained developed images of excellent resolution with minimal or substantially no background deposits. One of the main advantages of the present invention resides in the use of charging elements that contain ionically conducting materials, such as water, ionic polymers, crosslinked, or gel like polymers filled with water or other ionic liquids, and the like.

The charging of photoconductive and ionographic imaging members by means of corona discharge methods is known, however, a number of disadvantages are associated with these methods with respect to charging photoconductors, such as the generation of ozone, the use of high voltages, such as from about 6,000 to about 7,000 volts, which requires the use of special insulation, maintenance of the corotron wires at added costs, low charging efficiency, the need for erase lamps and lamp shields, and the like. Since it is a health hazard, ozone is removed by passage through a filter. Corona charging generates oxides of nitrogen which eventually desorb from the corotron surfaces and eventually oxidize the transport molecule thereby adversely effecting the electrical properties of the photoreceptor. These can show up as print deletions.

Generally, the process of electrostatographic copying is initiated by placing a substantially uniform electrostatic charge on a photoreceptive member. Subsequent to this charging, imaging is accomplished by exposing a light image of an original document onto the substantially uniformly charged photoreceptive member. Exposing the charged photoreceptive member to a light image discharges the photoconductive surface thereon in areas corresponding to nonimage areas in the original document while maintaining the charge in image areas, thereby creating an electrostatic latent image of the original document on the photoreceptive member. This latent image is subsequently developed into a visible image by depositing charged developing material onto the photoreceptive member such that the developing material is attracted to the charged image areas on the photoconductive surface. Thereafter, the developing material is transferred from the photoreceptive member to a copy sheet or to some other image support substrate for creating a visible image which may be permanently affixed to the image support substrate, thereby providing a reproduction of the original document. In a final step in the process, the photoconductive surface of the photoreceptive member can be cleaned to remove any residual developing material which may be remaining on the surface thereof in preparation for successive imaging cycles.

Illustrated in U.S. Pat. No. 5,485,253, the disclosure of which is totally incorporated herein by reference, is a corona generating device and, more particularly, a reusable corona charging apparatus for use in an electrostatographic printing machine to generate a flow of ions onto an adjacent imaging surface so as to alter the electrostatic charge thereon.

The electrostatographic copying process described hereinabove is well known and is commonly used for light lens copying of an original document. Analogous processes also exist in other electrostatographic printing applications such as, for example, digital laser printing where a latent image is formed on the photoconductive surface via a modulated laser beam, or ionographic printing, and reproduction where charge is deposited on a charge retentive surface in response to electronically generated or stored images.

In addition to charging the imaging surface of an electrostatographic system prior to exposure, corona devices are used to perform a variety of other functions in the electrostatographic process. For example, corona generating devices aid in the transfer of an electrostatic toner image from a reusable photoconductive imaging member to a transfer member such as paper; the tacking and detacking of the transfer member to and from the imaging member; and the conditioning of the surface of the imaging member prior to, during, and after deposition of toner thereon to improve the quality of the electrostatographic copy produced thereby. Each of these functions can be accomplished by a separate and independent corona generating device. The relatively large number of devices within a single machine necessitates the economical use of corona generating devices.

Various types of charging devices have been used to charge or precharge the surface of a photoconductive member. Corona generating devices are used extensively, wherein a voltage of 2,000 to 10,000 volts may be applied across an electrode to produce a corona spray which imparts electrostatic charge to a surface situated in close proximity thereto. One particular corona generating device includes a single corona generating electrode strung between insulating end blocks mounted on either end of a channel formed by a U-shaped shield or a pair of spaced side shield members. The corona generating electrode is typically a highly conductive, elongated wire positioned opposite the surface to be charged. In other conventional corona generating devices, the corona generating electrode may also be in the form of a pin array. Another device, frequently selected to provide more uniform charging and to prevent overcharging, includes two or more corona generating electrodes with a control grid comprising a screen having a plurality of parallel wires or a plate having multiple apertures positioned between the corona generating electrodes and the photoconductive member. In this device, a potential having the same polarity as that applied to the corona electrodes but having a much smaller voltage magnitude, usually about a few hundred volts, is applied to the control grid to suppress the electric field between the control grid and the corona electrodes, markedly reducing the ion current flow to the photoconductive member.

Yet another type of corona generating device is described in U.S. Pat. No. 4,086,650 wherein a corona discharge electrode is coated with a relatively thick dielectric material, such as glass, for substantially preventing the flow of conduction current therethrough. In this device, the delivery of charge to the photoconductive member is accomplished by a displacement current or by capacitive coupling through the dielectric material. The flow of ions to the surface to be charged is regulated by means of a DC bias applied to the shield of the corona generating device. In operation, an AC potential of approximately 5,000 to 7,000 volts is applied to the coated electrode at a frequency of about 4 KHz to produce an actual corona generating current of approximately 1 to 2 milliamperes. This device has the advantage of providing a uniform charge to the photoconductive member using a charge generating device that is highly insensitive to contamination by dirt and, therefore, does not require repetitive cleaning or other maintenance requirements.

One problem associated with corona generating devices occurs in the presence of the generated corona, wherein a region of high chemical reactivity is also produced such that new chemical compounds are synthesized in the machine air. This chemical reactivity correspondingly causes a build up of chemical growth on the corona generating electrode as well as other surfaces adjacent thereto. After a prolonged period of operation, these chemical growths may degrade the performance of the corona generating device and also the entire electrostatographic machine.

Free oxygen, ozone, and other corona effluents, such as nitrogen oxide, and nitrogen oxide species, can be produced in the corona region. These nitrogen oxide species react with solid surfaces. In particular, it has been observed that these nitrogen oxide species are adsorbed by the conductive control grid, the shield, shield members and other components of the corona generating device. The adsorption of nitrogen oxide species occurs even though the corona generating device may be provided with a directed air flow during operation for removing the nitrogen oxide species as well as controlling ozone emissions. During the process of collecting ozone, directed air flow may exacerbate problems by carrying the nitrogen oxide species to an affected area of the corona generating device, or even to some other machine part.

The reaction of corona generating process byproducts, such as nitrogen oxide, with the shield, the control grid, or other corona generating device components can result in corrosive buildup and deposition on the surfaces thereof. These deposits can cause problems, such as nonuniform photoreceptor charging, manifested by side-to-side print density variations, or dark and light streaks in an output copy. Also, depending on environmental conditions, deposits may charge up and effectively increase the shield or screen voltage resulting in similar nonuniformity defects. Extreme cases of corrosion can lead to arcing between the corona generating electrode and the screen on the shield members.

Another problem associated with corona generating devices operating in a electrostatographic environment results from toner accumulation on the surface of the corona generating electrode as well as surfaces adjacent thereto. The spots of accumulated toner, being a dielectric in nature, tend to cause localized charge build up on the interior surfaces of the shield which produces current nonuniformity and reduction in corona current. Localized toner accumulations on the insulating end blocks, which support the wire electrode, also cause sparking.

Moreover, adsorption can be a physically reversible process such that the adsorbed nitrogen oxide species are gradually desorbed when a machine is turned off for an extended period of idleness. The adsorbed and desorbed species are both nitrogenous, but not necessarily the same, that is there may be a conversion of $NO_2$ to $HNO_3$. When the operation of the machine is resumed, a copy quality defect, commonly referred to as a parking deletion, can result wherein a line image deletion or a lower density image is formed across the width of the photoreceptor at that portion of its surface resting opposite the corona generating device during the period of idleness. It is believed that the nitrogen oxide species interact with the surface of the photoreceptor to increase the lateral conductivity thereof such that the photoreceptor cannot effectively retain a charge in image configuration. This phenomenon basically causes narrow line images to blur or to wash out so as to not be developed as a toner image.

In corona generating devices, it has been found that the material from which the components, such as the shield or control grid, are fabricated has a significant effect on the severity of parking deletions. In the prior art, stainless steel materials have commonly been used shields. Other materials, such as corrosion resistant ferrous materials, which prevent the rapid oxidation of the component material and the concurrent loss of performance of the corona generator, have met with limited success, primarily due to the corrosive effect of the corona produced by the device.

In other attempts to reduce the problems associated with corona charging, considerable effort has been accomplished to reduce the adsorption of nitrogen oxide species by device components via the application of electrodag coatings to the surfaces thereof. These coatings typically include a reactive metal base such as nickel, lead, copper, zinc or mixtures thereof. These reactive metal base materials tend to absorb, or form harmless compounds with the nitrogen oxide species. However, parking deletion problems have continued due, for example, to the failure of the electrodag materials to continue to absorb or form harmless compounds with the nitrogen oxide species over time. In addition, certain components needed to address this problem are costly to fabricate.

U.S. Pat. No. 4,258,258 discloses a corona generating device having a corona generating electrode supported between a pair of end block assemblies. Each end block assembly defines a space for the passage of the electrode, and nonconductive inserts for surrounding the electrodes that are seated in the spaces of the end block assemblies. The nonconductive inserts are made from a high dielectric strength material that is also resistant to a corrosive atmosphere. The inserts are easily and inexpensively replaced so as to protect the end block assemblies from the effects of high voltage applied to the corona electrode.

U.S. Pat. No. 4,585,320 discloses a corona generating device for depositing negative charge on an imaging surface carried on a conductive substrate comprising at least one elongated conductive corona discharge electrode, means to connect the electrode to a corona generating potential source, at least one element adjacent the corona discharge electrode capable of adsorbing nitrogen oxide species once the corona generating electrode is energized, and capable of desorbing nitrogen oxide species once that electrode is not energized, the element being plated with a substantially continuous layer of lead to neutralize the nitrogen oxide species when generated. In a preferred embodiment, the corona discharge electrode comprises a thin wire coated at least in the discharge area with a dielectric material and at least one element comprising a conductive shield, and an insulating housing having two adjacent sides to define the longitudinal opening to permit ions from the electrode to be directed toward a surface to be charged, both the shield and the two sides of the housing being plated with a continuous thin layer of lead.

U.S. Pat. No 4,585,322 discloses a corona generating device similar to that discussed in previously referenced and described U.S. Pat. No. 4,505,320, wherein the element adjacent the corona discharge electrode capable of adsorbing nitrogen oxide species once the corona generating electrode is energized and capable of desorbing nitrogen oxide species once that electrode is not energized is coated with a substantially continuous thin dehydrated alkaline film of an alkali silicate to neutralize the nitrogen oxide species when generated.

U.S. Pat. No. 4,585,323 discloses a corona generating device similar to that described in above referenced and described U.S. Pat. No. 4,585,320 and U.S. Pat. No. 4,585,322, wherein the element adjacent the corona discharge electrode capable of adsorbing nitrogen oxide species once the corona generating electrode is energized and capable of desorbing nitrogen oxide species once that electrode is not energized is coated with a substantially continuous thin layer of a paint containing reactive metal particles, which will combine with the nitrogen oxide species, the reactive metal being present in the paint in an amount sufficient to neutralize the nitrogen oxide species when generated. Preferably, the reactive metal particles comprise lead, copper, nickel, gold, silver, zinc or mixtures thereof. Also of interest are U.S. Pat. Nos. 2,987,660, see for example column 2, lines 50 to 68, column 3, lines 49 to 70, and specifically column 3, lines 59 to 61, wherein water is mentioned as a conductive liquid; U.S. Pat. Nos. 3,394,002 and 2,904,431.

Illustrated in U.S. Pat. No. 5,457,523 the disclosure of which is totally incorporated herein by reference, is an apparatus for charging a member comprising:

a fluid media which can be water;

means for storing the fluid media;

means for contacting the fluid media with the member to be charged; and means for applying an electrical bias to the fluid media, wherein the electrical bias transports ions through the fluid media to the member to be charged for transferring ions thereto.

In U.S. Pat. No. 5,510,879, the disclosure of which is totally incorporated herein by reference, is illustrated a process for charging layered imaging members by the transfer of ions thereto from an ionically conductive medium, such as water. More specifically, in embodiments the process of this copending application comprises the ionic conduction charging of photoconductive imaging members, which process comprises contacting a component, such as a liquid like water, with the surface of the imaging member; and applying a voltage to the component while rotating or translating the imaging member thereby enabling the transfer of ions, preferably of a single sign, such as positive or negative polarity, from the liquid/imaging member interface to the imaging member. The photoreceptor thus becomes charged by the voltage applied to the liquid component in contrast to applying a voltage directly to the photoreceptor by a corotron. In embodiments, an ionic liquid, such as distilled water equilibrated with atmospheric air contained in an absorbent sponge, blades, rolls and the like, is biased by a voltage about equal to the surface potential desired on the photoreceptor, and ions of the desired polarity are deposited at the point of contact until the voltage on the imaging member becomes substantially equal to the applied voltage.

SUMMARY OF THE INVENTION

Examples of objects of the present invention include:

It is an object feature of the present invention to provide processes and devices for charging with many of the advantages illustrated herein.

It is yet another object of the present invention to provide processes and devices or apparatuses for the charging of ionographic imaging members.

Another object of the present invention relates to the ion transfer charging of ionographic imaging members.

Moreover, in another object of the present invention there are provided processes wherein corona charging devices for the charging of ionographic members can be eliminated.

Additionally, in another object of the present invention ionically conductive liquids and ionically conductive polymers are selected for the charging of ionographic members.

Also, in another object of the present invention, ionically conductive liquids and ionically conductive polymers are selected for the charging of ionographic members and wherein the mechanism of charging is the transfer of ions to the imaging member.

A further object of the present invention resides in the provision of apparatuses and processes for charging ionographic members by the transfer of ions thereto, and which members can be selected for a number of imaging processes including xerographic imaging and printing methods such as full color, highlight color, trilevel color processes, and more specifically ionographic imaging methods.

These and other objects of the present invention can be accomplished in embodiments thereof by the provision of devices and processes for the charging of ionographic members. In embodiments, the process of the present invention comprises the charging of ionographic members by the transfer of ions thereto. In embodiments the present invention relates to an apparatus for charging an ionographic member, comprising a substrate containing affixed thereto a plurality of electroded grooves each capable of retaining a single wettable fiber, thereby forming a collection of fibers in contact with the substrate; a resin layer that isolates said fibers from each other, and that adheres the fibers to the electroded grooves; means for providing an ionically conductive fluid to said collection of fibers; means for applying an electrical bias to said fibers thereby transporting ions through the fibers to the surface of said ionographic member, and which ions charge said member.

Figure 1:
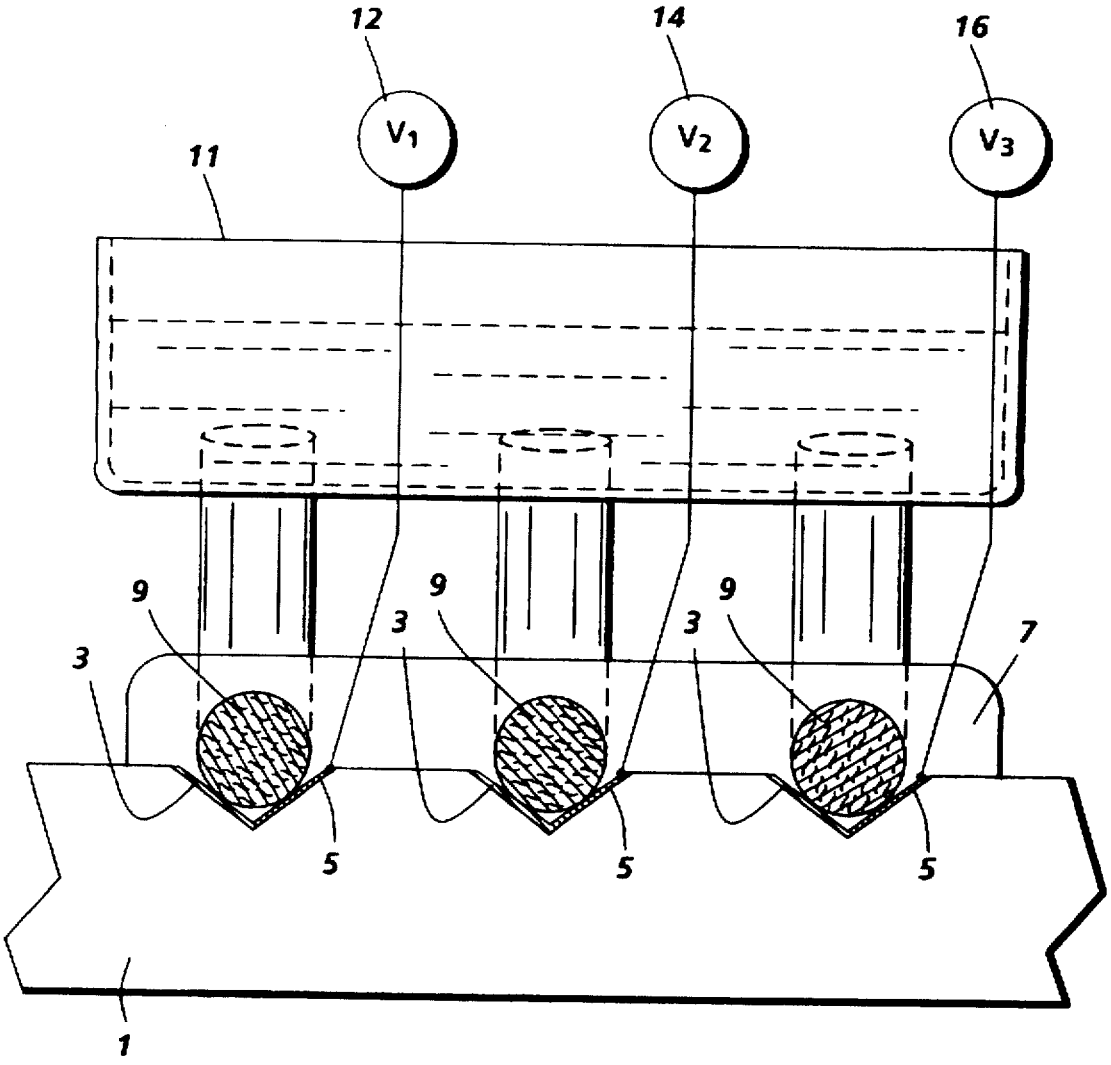
FIG. 1 represents a schematic elevational view of the process and apparatus of the present invention, wherein 1 is a nonflexible layer, 3 represents grooves, especially etched grooves, with a metal 5, like gold attached thereto, 7 represents a resin layer, or an encapsulating layer, 9 represents a wettable fiber, 11 represents an aqueous reservoir preferably containing water, and 12, 14, and 16 represent voltages sources, and wherein a voltage is applied to the metal situated in the grooves. The fibers are wetted by the water contained in the reservoir, and ions contained in the water are transported to a member, such as an ionographic member, and wherein the member is charged by the ions as indicated herein.

Further reference to FIG. 1, which in embodiments is referred to as an aquagraphic device, contains metallized electrodes 3 and 5, and the spacing between the electrodes is, for example, from about 200 to about 600 lines per inch, which corresponds to the pixel density, or in embodiments about a 1 to about a 5 mil (mil=0.001 inch) spacing between 1 mil electrodes.

A series of 3 mil diameter fibers are spaced 1 to 3 mils apart by laying individual fibers in the grooves of a non-flexible electrically insulating substrate. The fibers are preferably comprised of a material, such as cellulose or polyvinylalcohol crosslinked with formaldehyde thus rendering them suitable for the of wicking water, or the wicking of an ionically conductive water solution of an electrolyte. The grooves can be introduced into the substrate by micromechanical fabrication, by laser cutting, by a chemical etch into a silicon wafer, and the like. The latter is commonly done in the manufacture of thermal ink jet heads. After the fibers are placed in the groove, they are overcoated, or encapsulated with a non-hydrophilic, nonpermeable polymer which does not absorb water. Examples of overcoating resins include crosslinkable epoxy resins, polystyrene, polyimide and the like. The thickness of the overcoating layer in embodiments should be at least equal to the diameter of the fiber. Overcoating of the fibers also causes each fiber to be physically and electrically separated from one another. The overcoating polymer can be draw bar coated, dip coated or spray coated. The writing end of the fibers, that is for example the end which contacts the ionographic receiver is free of the overcoating polymer. The other end of the fiber bundle is exposed to a reservoir of an ionically conducting species such as distilled water equilibrated with air, or water containing a dissolved electrolyte as indicated herein. The solvent need not be water, but can be any solvent or solvent mixture which dissolves an electrolyte, or atmospheric carbon dioxide. To provide electrical contact with each fiber, the surface of each groove is metallized, preferably with a known metal like gold, which is resistant to corrosion. Each stylus of fiber is individually addressable and can be turned on and off imagewise as the ionographic receiver is rotated past the contacting stylus.

More specifically, the fiber stylus is in embodiments 3 mils in diameter. Each of the electrodes is individually addressable and, for example, switching on the voltages from sources 12, 14, and 16, for 3.3 milliseconds at 1 inch per second permits the placement of a pixel at 300 dots per inch. To write a 300 dpi pixel of charge on the surface of receiver, the stylus voltage is turned on for 3.3 milliseconds. Thus, the rise time for writing charge on the receiver should be about 300 microseconds or about one tenth of the time that the stylus voltage is on per pixel. This is accomplished to ensure that the written pixel size corresponds closely to the size of the stylus. Too long a rise time might result in a blurring of the pixel edge. This can be accomplished if the resistance of the stylus between the electroded (metallized) groove and the ionographic receiver is about equal to $10^5$ ohms. In this situation, the capacitance of the electrode is usually less than about 60 microfarads/$cm^2$, reference A. J. Bard and L. R. Faulkner, *Electrochemical Methods*, Wiley, 1982, New York, Chapter 12, the disclosure of which is totally incorporated herein by reference.

It is highly desirable that the resistance of the fiber stylus between the electrode contact and the reservoir be significantly higher (100 to 1,000×) than the resistance of the fiber between the electrode contact and the ionographic receiver. This is accomplished to limit the flow of current to the reservoir, and can be achieved, for example, when the distance to the reservoir is from about 1 about 10 centimeters. For example, when the distance to the ionic receiver is 0.1 millimeter, the distance to the reservoir is 10 centimeters and the resistance of the fiber between the electrode and ionic receiver is $10^5$ ohm, then the fiber resistance to the reservoir is $10^8$ ohms. The current flow to the reservoir per stylus, which is biased at −300 volts, is in embodiments about 3 microamps. Grounding the reservoir prevents current flow to other styli which are grounded (not "firing") and thus prevents electrical crosstalk between fibers.

The theoretical current flow to the ionographic receiver is illustrated by $$i=V_{app}\epsilon\epsilon_0(2r)v/d \quad (1)$$

wherein $V_{app}$ is the applied voltage (−300 volts), 2r is the relative dielectric constant (3), $\epsilon_0$ is the permittivity of free space, 2r is the diameter of the stylus (3 mil), v is the velocity of the dielectric receiver in cm/s, and d is the thickness (1 mil). Using the values in parentheses, a current flow of 0.7 nA is expected at a dielectric receiver velocity of 1 inch per second. One thus expects a iR or voltage drop of only a few microvolts between the electrode and the dielectric receiver. Thus, the applied bias is equal to the surface potential and hence the process is very efficient. Given an 8 inch wide array of fibers packed at 300 per inch implies a maximum current of 7.2 milliamps and a total power consumption of about 2 watts.

The ionographic member thus becomes charged by the voltage applied to the wetted fiber in contrast to applying a voltage to the photoreceptor by a corotron. In embodiments, an ionic liquid, such as distilled water contained in an absorbent sponge, blades, rolls and the like, is biased by a voltage about equal to the surface potential desired on the photoreceptor, and ions of the desired polarity are deposited at the point of contact until they reduce the field across the molecular dimensioned fluid gap to zero (0).

Examples of ionically conductive media include distilled deionized water, tap water, other similar effective media, and the like. Components, which can be added to the water phase to render it ionically conductive, include atmospheric carbon dioxide ($CO_2$), alkali metal carbonates like lithium carbonate, sodium carbonate, potassium carbonate, sodium bicarbonate and the like. The concentration ranges for such components can vary from trace levels to saturation. The applied voltage can range from about a minus 4,000 volts to positive 4,000 volts. Another example of an ionically conductive medium is a gel that is comprised of an effective amount, such as 4 weight percent of polyacrylic acid neutralized with a base, such as NaOH, containing an effective amount, such as 96 weight percent of water. Various doubly charged ions, such as $Ca^{2+}$, in the form of $Ca(OH)_2$ basic components like amines, and the like can be added to the gel to enhance the ionic conductivity of the gel and to enhance the crosslinking of the gel. The charge applied to the ionographic member medium can be of a positive polarity or a negative polarity, and is of a value of, for example, from about (positive or negative) ±1 volt to ±4,000 volts and preferably from about ±200 volts to ±800 volts. The sign of the charge, which is deposited, is primarily controlled by the sign of the voltage which is applied. Application of a positive bias to the ionically conductive medium causes positive ions to transfer to the imaging member. Application of a negative bias to the ionically conductive medium causes negative ions to transfer to the imaging member. The thickness of the interface, which is responsible for the transfer of ions, is of molecular dimensions and can vary from about 100 Å to about 5 Å depending on the concentration of the ions in the solution, the lower concentrations providing the thicker interfaces. For example, when the member is moving at 20 inches per second and the nip width of the charging medium is 0.1 inch (typical) then the imaging member is in contact with the charging element for about 5 milliseconds. Also, when the member is moving at 1 inch per second and the nip width is 1 inch, the ionographic member is in contact with the charging element for 1 second.

Figure 2:
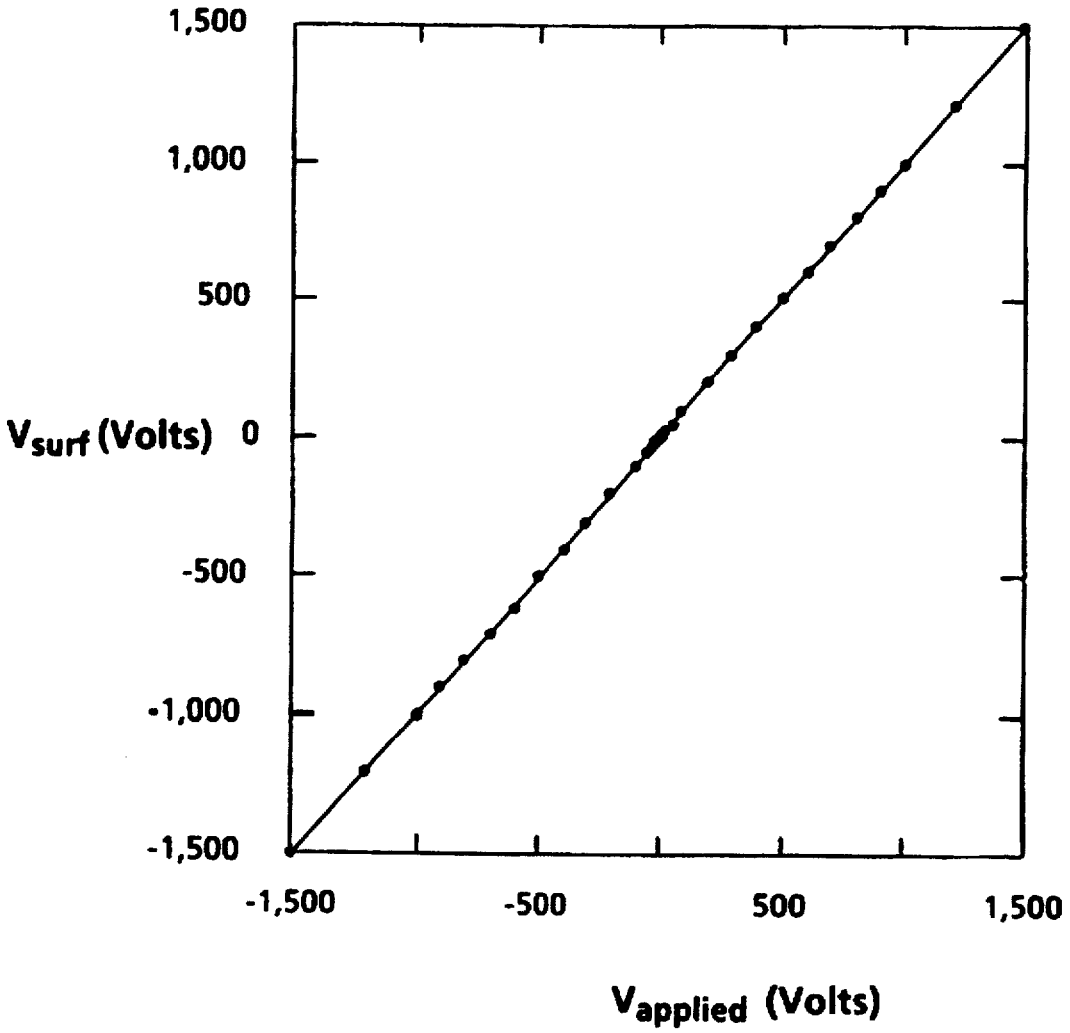
FIG. 2 shows the maximum voltage.

A conductive material is contacted with the liquid or the species carrying the liquid in order to apply the voltage to the liquid. The conductive material can be copper wire, or a container fabricated of brass, stainless steel, aluminum and the like. The container can be comprised of conductive composite materials such as a carbon loaded polymer or plastic. The conductivity can be as low as about 1 micromho/cm. The maximum voltage to which the member can be charged is the applied voltage (as shown by FIG. 2).

The charging of the member can be limited to this value since the electric field at the interface between the ionically conductive medium and the member drops to zero when the voltage on the imaging member reaches the applied voltage, and neglecting any IR or voltage drops in the ionically conductive medium itself. The member can be undercharged if insufficient time is allowed for contact between the imaging member and the ionically conductive medium. The degree of undercharging is usually not significant (25 to 50 volts) and can be compensated for by the application of a correspondingly higher voltage to the ionically conductive medium. The evidence that no ozone is formed between −800 volts and +800 volts is that no corona is observed and measurements of ozone are below the detection threshold (ca. 0.05 ppm) of the measurement technique.

The present invention encompasses the contact of both ionically conductive liquids (fluid-based ion donors) and ionically conductive solids (solid-state ion donors) with the ionographic imaging member. Fluid ion donors are composed of a carrier fluid solvent and soluble ionizable species or electrolytes. Suitable solvents include water, alcohols such as ethanol, isopropanol, and polyols such as glycerol, ketones such as acetone, aromatic hydrocarbons such as toluene, xylene, hydrocarbons of the formula $C_nH_{2n+2}$ where n=from about 5 to 20, and liquids capable of dissolving ionizable molecular species or electrolytes. Dissolved salts in effective amounts, such as from about 0.5 to about 20 percent in embodiments, can be added such as, for example, those represented by the general formula $M^+X^-$, where $M^+$ is a positively charged molecular species such as $H_3O^+$, $Li^+$, $Na^+$, $K^+$, $Rb^+$, $Cs^+$, $Be^{2+}$, $Mg^{2+}$, $Ca^{2+}$, $Sr^{2+}$, $Ba^{2+}$, transition metal cations like $Fe^{2+}$, $Co^{2+}$, $Ni^{2+}$, $Cu^{2+}$, $Zn^{2+}$, lanthanide cations, ammonium, alkylammonium, alkylarylammonium, tetraphenylarsonium, tetraphenylphosphonium, pyridinium, piperidinium, imidazolinium, guanidinium, polymeric cations like polyvinylpyridinium, and $X^-$ is a negatively charged molecular species such as $F^-$, $Cl^-$, $Br^-$, $I^-$, $HF_2^-$, $ICl^{2-}$, $SO_4^{2-}$, $SO_3^{2-}$, $HSO_4^-$, $CO_3^{2-}$, $HCO_3^-$, $NO_3^-$, $NO_2^-$, $ClO_4^-$, $BrO_4^-$, $PF_6^-$, $SbF_6^-$, $AsF_6^-$, $AsO_4^{3-}$, $As_2O_7^{4-}$ $BO_2^-$, $BrO_3^-$, $ClO_3^-$, $BeF_4^{2-}$, $Fe(CN)_6^{3-}$, $Fe(CN)_6^{4-}$, $FSO_3^-$, $GeO_3^{2-}$, $OH^-$, $IO_3^-$, $IO_4^-$, $IO_6^{5-}$, $MnO_4^-$, $MnO_4^{2-}$, $SeO_4^{2-}$, $SeO_2^{2-}$, $SiO_3^{2-}$, $SiO_4^{4-}$, $TeO_4^{2-}$, $SCN^-$, $OCN^-$, $WO_4^{2-}$, $VO_3^-$, $VO_4^{3-}$, $V_2O_7^{4-}$, $SiF_6^-$, phosphate, hypophosphate, metaphosphate, orthophosphate, metatungstate, paratungstate, molybdotungstate molybdate, and anionic inorganic complexes, acetate, adipate, alkanoate, benzenesulfonate, benzoate, camphorate, cinnamate, citrate, formate, fumarate, glutamate, lactate, maleate, oleate, oxalate, phenoxide, phthalate, salicylate, succinate, tartrate, triflate, trifluoracetate, toluenesulfonate, the polymeric anions polyacrylates, or polystyrenesulfonate, and the like.

Specific examples of added salts include $Na_2CO_3$, $NaHCO_3$, $NaClO_4$, $LiClO_4$, $Na_2SO_4$, LiCl, NaCl, KCl, RbCl, CsCl, $MgCl_2$, $CaCl_2$, tetraethylammonium chloride, tetraethylammonium bromide, tetraethylammonium iodide, tetraethylammonium perchlorate, tetrabutylammonium perchlorate, cetylpyridinium chloride, or polyvinylpyridinium chloride.

Ionically conductive liquids include aqueous solutions of $Na_2CO_3$, $NaHCO_3$, $NaClO_4$, $LiClO_4$, $Na_2SO_4$, LiCl, NaCl, KCl, RbCl, CsCl, $MgCl_2$, $CaCl_2$, tetraethylammonium chloride, tetraethylammonium bromide, tetraethylammonium iodide, tetraethylammonium perchlorate, or solutions of tetrabutylammonium perchlorate, tetraethylammonium toluenesulfonate, cetylpyridinium chloride, polyvinylpyridinium chloride in ethyl alcohol, isopropyl alcohol, dichloromethane, acetonitrile. The concentration range can be from a trace level to saturation. The fluid can also be an ethanolic solution of tetraalkylammonium halide where halide is fluoride, chloride, bromide, iodide, tetraalkylammonium perchlorate, tetraalkylammonium sulfate, tetraalkylammonium p-toluenesulfonate and the like in concentrations from trace to saturation. The fluid can also be an alkane such as hexane, hexadecane or NORPAR 15™ containing CaAOT (AOT is dioctylsulfosuccinate), HBR-Quat salt, ALOHAS electrolytes or mixtures thereof.

One Mechanism of Operation

Pure water, which is equilibrated with a pure carbon dioxide atmosphere, contains dissolved carbon dioxide to the extent of 0.033 percent. Carbon dioxide is soluble to the extent of 0.14 gram per 100 milliliters of water. However, pure water, which is equilibrated with ambient atmosphere, contains 17 milliliters of dissolved air at standard temperature and pressure. The pH of air equilibrated distilled water is about 5.5 because of the aqueous hydrolysis of $CO_2$ in water represented by the chemical equations:

$$CO_2+H_2O=HCO_3^-H_3O^+$$

$$HCO_3^-+H_2O=CO_3^{2-}+H_3O^+$$

The aqueous hydrolysis of carbon dioxide dramatically decreases the ionic resistivity of pure water from about 18 megohms to about 100 kilohms for pure air-equilibrated water. Air-equilibrated water contains the ionic species hydronium ion, bicarbonate ion, carbonate ion, and to a small extent hydroxide ion. Thus, under negative applied voltages, bicarbonate and/or carbonate ion are predominantly transferred to the photoreceptor, or ionographic surface. Conversely, under positive applied voltages, hydronium ion is transferred to the surface. Thus, pure water, water based fluids and fluids mixed with water are expected to be ionically conductive, and wherein the conductivity is dominated by the ions therein.

One advantage of ion transfer relative to a corotron is that ozone production is significantly reduced when charging layered imaging members. Contact ionic charging generates, for example, less than 10 percent of the ozone that a corotron produces. At voltages between −800 volts and 800 volts, a corona is not visually observable in a completely darkened room with the process of the present invention. Also, the odor of ozone is not detectable with the process of the present invention. In addition, measurement of ozone showed less than about 0.05 ppm ozone generated, near the detection limit of the method. Since organic photoreceptors are usually charged to less than −800 volts, ion transfer charging of the present invention is for all practical purposes ozoneless. This eliminates one degradation mechanism, that is a print defect commonly known as a parking deletion. In addition, the need for ozone management and filtration is mitigated. Thus, ionic charging devices present a lower health hazard than a corotron or scorotron.

Numerous different ionographic members can be charged with the devices and processes of the present invention including poly(vinylidenefluoride), MYLAR®, and the like.

Subsequent to imagewise charging, the ionographic member is developed by contact with a developer containing toner comprised of resin and pigment, reference U.S. Pat. Nos. 4,469,770; 4,556,624; 4,298,672; 4,338,390; 4,937,166; 4,935,326, the disclosures of which are totally incorporated herein by reference; followed by transfer of the developed latent image to a substrate such as paper, and fusing the image thereto. Resin includes styrene methacrylates, styrene acrylates, styrene butadienes, polyesters, and the like; and examples of pigments include carbon black like REGAL 330®, cyan, magenta, yellow, red, blue, green, mixtures thereof, and the like.

The following Examples are being provided to further define various species of the present invention, and these Examples are intended to illustrate and not limit the scope of the present invention. Parts and percentages are by weight unless otherwise indicated.

EXAMPLE I

An aluminized MYLAR® substrate, 2 mils thick, 3 inches wide and 19 inches in length, was taped onto an aluminum drum which was 3 inches wide and 6 inches in diameter. The aluminized side of the MYLAR® film was contacted with the aluminum drum surface forming a ground plane. The rotation speed of the drum was electronically controlled so that the circumferential velocity was variable from about 2 inches per second to about 15 inches per second. A plastic beaker was placed beneath the drum at the "six o'clock" position and filled with municipal tap water. The level of the water was higher than the edge of the beaker forming a meniscus. A copper wire was placed through the wall of the beaker and the hole sealed with a silicone polymer. The end of the copper wire was bare so that the voltage could be applied to the water inside the beaker. The voltage was applied by a Trek Corotrol power supply which was capable of supplying either positive or negative voltages. An electrostatic voltmeter was mounted at the "three o'clock" position to detect the surface voltage on the MYLAR® surface.

The high surface tension of the water (72 mN/m) not only allows the plastic beaker to be overfilled, but also prevents wetting of the MYLAR® surface. Thus, upon rotation the drum passes through the water meniscus, but the water does not wet the MYLAR® surface. Care was taken to insure that the water meniscus did not wet the edges of the drum in order to avoid short circuiting to the ground plane. A voltage of −800 volts was applied to the water in the beaker, and then the drum was rotated counterclockwise at about 3 inches per second for a quarter to a half of a turn and stopped. A reading was taken from the electrostatic voltmeter and recorded. The applied voltage was then varied from −1,500 volts to +1,500 volts and, following the above procedure, the electrostatic surface voltage was recorded at several applied voltages, $V_{app}$.

A plot of the electrostatic surface voltage versus the voltage applied to the water reservoir is shown in Graph 1. The voltage developed on the MYLAR® surface is, within a few tenths of a percent, the same as the voltage applied to the water reservoir. Both positive and negative voltages are developed on the MYLAR® surface with virtually 100 percent voltage efficiency. That charging, which occurs at voltages less than the minimum of the Paschen curve (about 400 volts), indicates that the charging mechanism does not involve air breakdown (corona) but rather involves a transfer of ions at the liquid/MYLAR® interface.

Measurement of Charge Transfer Uniformity

The measurement of charge transfer uniformity was conducted at a $V_{app}$=−800 volts. The water reservoir was then removed and the drum was rotated at 2 inches per second while measuring the surface voltage using the ESV. The voltage readings on the MYLAR® showed a plus or minus 2 volts variation in the circumferential direction of the drum. The charge transfer uniformity was also measured by moving the ESV on a precision translation stage. The variation in surface charge in the lateral direction from −800 volts was plus or minus 2 volts.

EXAMPLE II

Charging by Other Liquids

The charging characteristics of other liquids were also investigated by a procedure of Example I. Distilled deionized water was used as an example of a liquid that contains no purposely added ions. This water was purified by successive filtration through a reverse osmosis filter, a carbon filter to remove organic materials, and two deionizing filters. The water was then distilled under high purity argon from an alkaline permanganate reservoir. This was followed by a second distillation. The purified water was stored under an ultrahigh purity argon atmosphere. The charging characteristics of distilled water were substantially identical to tap water. This was due to the aqueous hydrolysis of dissolved carbon dioxide gas which yielded dissolved bicarbonate and carbonate ions as well as hydronium ions. The resistivity of the purified water in equilibrium with ambient air was about 100 kilohms. Other aqueous media can be used to charge MYLAR®, including Coke Classic and Pepsi brand soft drinks. These charge the surface with about the same efficiency as tap water.

EXAMPLE III

NORPAR 15™, a straight chain aliphatic hydrocarbon (chain length is about C15 sold by Exxon Chemical Corporation, Houston, Tex.), was used to charge aluminized MYLAR®. The hydrocarbon contained ≦5 weight percent ionizable charge directors, such as barium petronate or a surfactant of HBr Quat, comprised of 80 mole percent of 2-ethylhexylmethacrylate and 20 mole percent of dimethylaminoethyl methacrylate hydrobromide. NORPAR® solutions containing the latter and the former both charged the surface efficiently, that is about 100 percent. The charging curve for NORPAR® containing either barium petronate or HBr Quat is indistinguishable from that of Graph 2.

EXAMPLE IV

Developability of the Surface Charge: A MYLAR® surface was charged as in Example I to a voltage of +500 volts. The surface charge on MYLAR® is known to be stable for very long periods of time (days). The MYLAR® was removed from the drum fixture and immediately fitted into a toner developing fixture. A negative charging polyester toner containing 1 weight percent of potassium tetraphenylborate charge control agent, and cyan pigment, available as MAJESTIK® toner from Xerox Corporation was then developed onto the charged MYLAR® surface to determine the lateral uniformity of the transferred ionic charge and whether the surface charge would allow toner to adhere electrostatically to the MYLAR® surface. A uniform even coating of toner was indeed transferred to the MYLAR® surface. The solid area image was fixed by heating to 120° C. in a convection oven for several seconds.

EXAMPLE V

Charging with a Fiber Tip

A single cellulose wick, tradename TRANSORB™, of a diameter of 20 mils was sharpened to a point with a surgical blade. The tip diameter was about 8 mils. The fiber was completely wetted with water. The resistance of the wick was measured with an ohmmeter with the probes placed 0.5 inch apart. The wick was then dried back so that the measured resistance was between 1 and 10 megohms and then was affixed to a translatable stage. The translation rate was controllable in 1-2-5 steps from 0.5 sec/inch to 10 sec/inch. An electrical contact was made to the wick near the tip by sandwiching the fiber between a pair of metal plates. Water used to wet the wick was purified by successive filtration through a reverse osmosis filter, deionization (cation and anion exchange), passage through activated carbon to remove organic impurities and ultrafiltration through a 0.2 micron filter. Identical results are obtainable with ordinary tap water.

The voltage excitation was supplied by a Trek Model 610B Amplifier which was driven by a Wavetek Model 801 pulse generator. The magnitude of the pulse generator voltage was adjusted so that the output of the amplifier switched between 0 volt (off state) to +800 volts (on state). A slight ringing of the amplifier was noted when the square pulses were 2 milliseconds on and 2 milliseconds off, i. e. a square wave frequency of 250 Hz. A 2 mil sheet of aluminized MYLAR® (approximately 8"×10") served as the ionographic receiver. The wick was translated at 2 inches per second while the voltage excitation was switched between 0 volt and +800 volts at 250 Hz. This deposited a latent image of positive charge which was periodic in nature. The image was developed by powder cloud development. One of the toners used to develop the latent image was a Xerox Corporation toner for the 8200/9500 toner. Alternatively, a yellow toner (Model 6500 yellow developer) was used to develop color images. The image was fixed for 5 to 10 seconds in a convection oven at 120° C. Microscopic examination of the image at 100 power magnification showed a pattern of 4 mil diameter dots which were 8 mils apart center to center or 4 mils apart edge to edge. The 4 mil diameter of the yellow dots corresponds exactly to the 2 millisecond on pulse (+800 volts) and with the 250 Hz pulse frequency. The 4 mil space between the yellow (or black) dots corresponds exactly to the 2 millisecond off pulse (0 volt). These results also show that lateral transport of charge does not occur on the MYLAR® substrates. The shape of the deposited charge could be varied by changing the pulse width on and off time and translation rate of the fiber. For example, by changing the pulse width to 20 milliseconds and the pulse period to 200 milliseconds, and keeping the translation rate at 2 seconds per inch a pattern of 40 mil lines and 360 mil spaces was obtained.

EXAMPLE VI

A series of 16 wicks composed of polyvinylalcohol crosslinked with formaldehyde with tip width of about 125 mils were affixed to an electrically insulating substrate, a printed circuit board. The center to center distance was about 200 mils. The wicks were physically and electrically separated by taping down to a printed circuit board. Each was biased at either 0 volt or at +500 volts with a pulse duration of about 100 milliseconds. The wicks were held in contact with a MYLAR® dielectric receiver. The wicks were then translated at a speed of 20 seconds per inch while in contact with the dielectric receiver. A series of 200 millisecond pulses at +500 volts were applied to the wetted wicks thus writing a series of charged lines. Each of the lines was turned on sequentially. The MYLAR® films were cascade developed with a Xerox Corporation 8200/9500 black toner. The image was fixed by heating to about 150° C. in a convection oven for several seconds. The zig-zag pattern of charge on the surface corresponded to the wicks which were turned on.

EXAMPLE VII

Charging with a Fiber Tip at Both Positive and Negative Voltages

A single cellulose wick, TRANSORB™, of diameter 20 mils was sharpened to a point with a surgical blade. The tip diameter was about 8 mils. The fiber was completely wetted with water. The resistance of the wick was measured with an ohmmeter with the probes placed 0.5 inch apart. The wick was then dried back so that the measured resistance was between 1 and 10 megohms, and then was affixed to a translatable stage. The translation rate is controllable in 1-2-5 steps from 0.5 sec/inch to 10 sec/inch. An electrical contact was made to the wick near the tip by sandwiching the fiber between a pair of metal plates. Water used to wet the wick was purified by successive filtration through a reverse osmosis filter, deionization (cation and anion exchange), passage through activated carbon to remove organic impurities and ultrafiltration through a 0.2 micron filter.

A 10 Hz square wave was applied to a single wick which was in contact with a MYLAR® ionographic receiver. During a single period of the square wave +500 volts was applied for 50 milliseconds followed by −500 volts for 50 milliseconds. The fiber was translated at 2 inches per second. This deposited a trail of charge which alternated between 100 mil segments at +500 volts and 100 mil segments at −500 volts. The charge was developed by a two step development process. First, the negative charge was imaged by cascade development with a Xerox 6500 yellow developer (5R94). Then, the positive charge was imaged by cascade development with Xerox 5775 cyan developer. The image was fused by exposing the MYLAR® sheet to the vapors of 1,2 dichloroethane for 20 seconds. Examination of the image showed a single line broken into segments 100 mils in length of alternating colors of yellow and cyan. The boundary between the adjacent yellow and cyan segments was very sharp.

A 250 Hz square wave was applied to a single wick which was in contact with a MYLAR® ionographic receiver. During a single period of the square wave +500 volts was applied for 2 milliseconds followed by −500 volts for 2 milliseconds. The fiber was translated at 1 inch per second. This deposited a trail of charge which alternated between 2 mils at +500 volts and 2 mils at −500 volts. The charge was developed by a two step development process. First, the negative charge was imaged by cascade development with a Xerox Corporation 6500 yellow developer (5R94). Then, the positive charge was imaged by cascade development with Xerox Corporation 5775 cyan developer. The image was fused by exposing the MYLAR® sheet to the vapors of 1,2 dichloroethane for 20 seconds. Examination of the image showed a single line broken into segments 2 mils in length of alternating colors of yellow and cyan. This corresponds to 500 dots per inch in the process direction. The boundary between the adjacent yellow and cyan segments was very sharp.

Thus, some factors controlling the pixel shape and density are the pulse width, pulse duty cycle and the center to center spacing of the individual fibers or ionic writing elements.

The apparatus of FIG. 1 can thus be selected to charge an ionographic member as indicated herein.

Other modifications of the present invention may occur to those skilled in the art subsequent to a review of the present application, and these modifications, including equivalents thereof, are intended to be included within the scope of the present invention.

What is claimed is:

1. A method for charging an ionographic member, comprising an electrically insulating substrate containing affixed thereto a plurality of electroded grooves each capable of retaining a single wettable fiber, thereby forming a collection of fibers in contact with the substrate; a resin layer that isolates said fibers from each other, and that adheres the fibers to the electroded grooves; providing an ionically conductive fluid to said collection of fibers; applying an electrical bias to said fibers thereby transporting ions through the fibers to the surface of said lonographic member and which ions charge said member.

2. A method in accordance with claim 1 wherein said grooves contain a metal to permit electrical contact thereof with said electrical bias, and wherein said fibers are substantially the same length.

3. A method in accordance with claim 1 wherein each of said fibers is of a diameter of from about 1 to about 5 mils, and the number of grooves is from about 1 to about 5,000.

4. A method in accordance with claim 1 wherein from about 1,000 to about 5,000 grooves are present.

5. A method in accordance with claim 1 wherein the substrate is substantially nonflexible and is of a thickness of from about 10 to about 50 mils.

6. A method in accordance with claim 1 wherein the resin layer encapsulates said fibers and said grooves, and which resin layer is of a thickness of from about 3 to about 10 mils.

7. A method in accordance with claim 2 wherein the metal is gold.

8. A method in accordance with claim 1 wherein the fluid is water.

9. A method in accordance with claim 1 wherein the bias is from about a negative 300 to about a negative 800 volts, and there is applied to said ionographic member, by contacting said fibers with said member, a surface voltage of from about a negative 300 to a negative 800 volts.

10. A method in accordance with claim 9 wherein the bias is applied near the tip, or in close proximity of the tip of said fibers, and the electrical bias enables the transport of ions through said fibers and through said fluid to the member to be charged.

11. A method in accordance with claim 1 wherein the fibers are hollow, and the substrate is comprised of a polymer or a rigid silicon wafer substrate.

12. A method in accordance with claim 1 wherein the fibers are comprised of an ionically conductive polymer, and said fibers are in contact with said metal portions of said grooves.

13. A method in accordance with claim 12 wherein the polymer is polyethylene oxide, a copolymer of polyethylene oxide with polyurethane, polyimide, silicone, or rubber.

14. A method in accordance with claim 1 wherein each individual fiber of said collectible fibers is overcoated with a uniform coating of an electrically insulating polymer film of a thickness of from about 0.1 to about 1 mil, and which polymer is optionally a polyimide, a polystyrene, or an epoxy.

15. A method in accordance with claim 1 wherein the wettable fibers are separated from each other by a thin overcoating polymer film, wherein the distance between the wettable fibers is from about 1 mil to about 5 mils, and wherein there are applied both positive and negative voltages to the ionographic member, said voltages being between about positive or negative 300 volts to about positive or negative 1,000 volts, respectively.

16. A method in accordance with claim 1 wherein the said fluid is an ionically conductive fluid that functions as a medium for transporting ions, and a medium for controlling the conductivity of each fiber.

17. A method in accordance with claim 1 wherein the fluid media is contained within a crosslinked polymer.

18. A method in accordance with claim 17 wherein the crosslinked polymer is comprised of an open microcell foam comprised of polyvinylalcohol crosslinked with formaldehyde.

19. A method in accordance with claim 1 wherein the ionographic member is comprised of silicon carbide, or polyvinylidene fluoride.

20. A method in accordance with claim 1 wherein the voltage applied from said fibers is from about ±1 volt to about ±5,000 volts, is from about ±50 volts to about ±1,000 volts, or is from about ±300 to about ±800 volts.

21. A method in accordance with claim 1 wherein the fluid media is an ionically conductive fluid containing salts of the formula $M^+X^-$, where $M^+$ is a positively charged organic or inorganic molecular species, and $X^-$ is a negatively charged organic or inorganic molecular species, and ozone emission is avoided.

22. A method in accordance with claim 1 wherein the fluid media is comprised of low evaporation liquids of polyethers, glycols, polyalcohols, azeotropes of said liquids with water, straight chain or branched aliphatic hydrocarbons, aromatic hydrocarbons, and mixtures thereof.

23. A method in accordance with claim 1 wherein the fluid media is comprised of a liquid or a gel containing an electrolyte or mixtures thereof of the general formula $M^+X^-$ thereby rendering the medium ionically conductive, and wherein $M^+$ is the positively charged molecular species such as $H_3O^+$, $Li^+$, $Na^+$, $K^+$, $Rb^+$, $Cs^+$, $Be^{2+}$, $Mg^{2+}$, $Ca^{2+}$, $Sr^{2+}$, $Ba^{2+}$, transition metal cations of $Fe^{2+}$, $Co^{2+}$, $Ni^{2+}$, $Cu^{2+}$, $Zn^{2+}$, a lanthanide cation, ammonium, alkylammonium, alkylarylammonium, tetraphenylarsonium, tetraphenylphosphonium, pyridinium, piperidinium, imidazolinium, guanidinium, polymeric cations like polyvinylpyridinium, protonated 2-ethylhexylmethacrylate-co-dimethylaminoethylmethacrylate, and wherein $X^-$ is a negatively charged molecular species of $F^-$, $Cl^-$, $Br^-$, $I^-$, $HF_2^-$, $ICl^{2-}$, $SO_4^{2-}$, $SO_3^{2-}$, $HSO_4^-$, $CO_3^{2-}$, $HCO_3^-$, $NO_3^-$, $NO_2^-$, $ClO_4^-$, $BrO_4^-$, $PF_6^-$, $SbF_6^-$, $AsF_6^-$, $AsO_4^{3-}$, $As_2O_7^{4-}$ $BO_2^-$, $BrO_3^-$, $ClO_3^-$, $BeF_4^{2-}$, $Fe(CN)_6^{3-}$, $Fe(CN)_6^{4-}$, $FSO^{3-}$, $GeO_3^{2-}$, $OH^-$, $IO_3^-$, $IO_4^-$, $IO_6^{5-}$, $MnO_4^-$, $MnO_4^{2-}$, $SeO_4^{2-}$, $SeO_2^{2-}$, $SiO_3^{2-}$, $SiO_4^{4-}$, $TeO_4^{2-}$, $SCN^-$, $OCN^-$, $WO_4^{2-}$, $VO_3^-$, $VO_4^{-3}$, $V_2O_7^{4-}$, $SiF_6^-$, phosphate, hypophosphate, metaphosphate, orthophosphate, metatungstate, paratungstate, molybdotungstate, molybdate, petronate, anionic organic complexes, acetate, adipate, alkanoate, benzenesulfonate, benzoate, camphorate, cinnamate, citrate, formate, fumarate, glutamate, lactate, maleate, oleate, oxalate, phenoxide, phthalate, salicylate, succinate, tartrate, triflate, trifluoracetate, toluenesulfonate.

24. An electrostatographic printing apparatus including a charging device for applying an electrical charge to an ionographic imaging member, which charging device is comprised of a substrate containing affixed thereto a plurality of electroded grooves each capable of retaining a single wettable fiber, thereby forming a collection of fibers in contact with the substrate; a resin layer that isolates said fibers from each other, and that adheres the fibers to the electroded groves; and means for providing an ionically conductive fluid to said collection of fibers; means for applying an electrical bias to said fibers thereby transporting ions through the fibers to the surface of said ionographic member, and which ions charge said member.

25. An electrostatographic printing apparatus in accordance with claim 24 wherein the electrical charge is in the form of a latent image, which image is developed with a dry toner, or a liquid toner; and wherein the image is transferred to a substrate and fixed thereto by heat.

26. A substantially ozone free process for the ion transfer charging of an Ionographic imaging member which comprises (1) providing a fiber bundle containing wettable fibers separated from each other by a thin film of an insulating material situated between them and an ionically conductive fluid media which wets the fibers; (2) contacting said wetted fibers with the Ionographic member to be charged; and (3) applying independent electrical biases to said fibers, wherein the electrical bias transports ions through said fibers to the member to be charged, thereby enabling the transfer of ions to said member.

27. A substantially ozone free process for the ion transfer charging of an ionographic imaging member which comprises (1) providing an electrically insulating substrate containing affixed thereto a plurality of electroded grooves each capable of retaining a single wettable fiber, thereby forming a collection of fibers in contact with the substrate and which fibers are contacted with an ionically conductive fluid; (2) a resin layer that isolates said fibers from each other, and that adheres the fibers to the electroded grooves; (3) applying an electrical bias to said fibers thereby transporting ions through the fibers to the surface of said ionographic member and which ions charge said member.

28. A process in accordance with claim 27 wherein the fluid media is comprised of water, and the ions originate from said water, and wherein said grooves contain a metal to permit electrical contact thereof with the electrical bias means; wherein said fibers are substantially the same length; wherein each of said fibers is of a diameter of from about 1 to about 5 mils, and the number of grooves is from about 1 to about 5,000; and wherein the bias is from about a negative 300 to about a negative 800 volts, and there is applied to said ionographic member, by contacting said fibers with said member, a surface voltage of from about a negative 300 to a negative 800 volts.

29. A process in accordance with claim 27 wherein each fiber functions similar to a pen, which pen provides ions to the member to be charged, and wherein each pen is rendered operative by an independent voltage, or bias applied to each pen tip.

* * * * *